US007016621B1

(12) United States Patent
Ng

(10) Patent No.: US 7,016,621 B1
(45) Date of Patent: Mar. 21, 2006

(54) BACK-TRANSFER REDUCTION IN A TANDEM ELECTROSTATOGRAPHIC PRINTER

(75) Inventor: Yee S. Ng, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/933,986

(22) Filed: Sep. 3, 2004

(51) Int. Cl.
*G03G 15/08* (2006.01)

(52) U.S. Cl. ..... 399/53; 399/296

(58) Field of Classification Search ..... None
See application file for complete search history.

(56) References Cited

U.S. PATENT DOCUMENTS 5,234,783 A 8/1993 Ng et al.
5,926,679 A * 7/1999 May et al. ..... 399/296
6,608,641 B1 8/2003 Alexandrovich et al.

* cited by examiner

*Primary Examiner*—Quana Grainger

(57) ABSTRACT

In a color electrostatographic printer apparatus having a plurality of tandem stations for applying respective color separation toner images to a receiver member, and a clear toner station for providing a clear toner overcoat to a multicolor toner image formed by the respective color separation toner images on the receiver member, a controller is provided that selectively controls deposition of clear toner to the multicolor toner image so that greater amounts of clear toner are deposited in image areas of the multicolor toner image having relatively higher density color and relatively lesser amounts of clear toner, including no clear toner, are deposited upon image areas of the multicolor toner image having relatively lower density color.

23 Claims, 8 Drawing Sheets

BACK-TRANSFER REDUCTION IN A TANDEM ELECTROSTATOGRAPHIC PRINTER

FIELD OF THE INVENTION

The invention relates to electrostatographic reproduction apparatus and methods, and more particularly to color electrostatographic printers wherein color toner separation images are serially deposited upon a receiver member.

BACKGROUND OF THE INVENTION

In an electrophotographic modular printing machine of known type, such as for example the NexPress 2100 printer manufactured by NexPress Solutions, Inc., of Rochester, N.Y., color toner images are made sequentially in a plurality of color imaging modules arranged in tandem, and the toner images are successively electrostatically transferred to a receiver sheet adhered to a transport web moved through the modules. Commercial machines of this type typically employ intermediate transfer members in the respective modules for the transfer to the receiver member of individual color separation toner images.

In a modular machine of this type, sequential lay-down of color separation toner images onto the receiver sheet generally gives rise to a space charge within the stack of as yet unfused toner particles. When at least two previously transferred toner layers are already stacked one upon the other on the receiver member from transfer by prior modules, it is noted that certain defects can occur in the previously deposited toner layer farthest away from the surface of the receiver member. These defects can take the form of mottle covering the whole affected area or bands of mottle. The defects result from back-transfer of toner particles to an intermediate transfer member from this outermost previously deposited toner layer.

As an example, when a receiver member has magenta and cyan toners transferred thereon (in the third and fourth modules of the machine which includes successive modules or stations for black, yellow, magenta, cyan and clear toner) so as to make a final blue color in a large solid area of an image frame, the back-transfer defects can occur when the receiver member moves through the clear toner depositing module when the selected mode of operation is for a print with no clear toner covering the entire image. In a printer having a fifth toner depositing station for depositing clear toner, it is desirable to have the operator be free to select whether or not clear toner is desired as the final coat. The provision of a clear toner overcoat is desirable for providing protection of the print from fingerprints and reducing certain visual artifacts. However, a clear toner overcoat may add cost and may reduce color gamut of the print, so it is therefore desirable to provide for operator/user selection to determine whether or not a clear toner overcoat will be applied to the entire print.

In order to prevent back-transfer of the toner to the clear toner intermediate transfer roller, it may be possible in certain machines to provide for retraction of the intermediate transfer roller from engagement with the receiver member. However this option adds complexity and thus cost to a printer with this feature. Another approach for reducing back-transfer has been suggested by Rakov et al., in commonly assigned U.S. Patent Application Ser. No. 60/567,219 filed on Apr. 30, 2004, entitled "TONER TRANSFER TECHNIQUE" wherein transfer control current is combined with information derived using process control conditions to inhibit back transfer. Inherent in this solution is the depositing of toner where required for the particular color and applying a suitable transfer current. No indication is provided with regard to back-transfer to the intermediate transfer roller when the selected mode of operation is for non-covering of the overall image by the clear transfer toner.

SUMMARY OF THE INVENTION

In accordance with a first aspect of the invention there is provided a tandem color electrostatographic printer apparatus having a plurality of stations for applying respective color separation toner images to a receiver member, and a clear toner station for providing a clear toner overcoat to a multicolor toner image formed by the respective color separation toner images on the receiver member. The apparatus further includes a controller for selectively controlling deposition of clear toner to the multicolor toner image so that greater amounts of clear toner are deposited in image areas of the multicolor toner image having relatively higher density color and relatively lesser amounts of clear toner, including deposits of no clear toner, are deposited upon image areas of the multicolor toner image having relatively lower density color.

In accordance with a second aspect of the invention there is provided, in a tandem color electrostatographic printer apparatus having a plurality of stations for applying respective color separation toner images to a receiver member and a clear toner station for providing a clear toner overcoat to a multicolor toner image formed by the respective color separation toner images on the receiver member, the method of selectively controlling deposition of clear toner to the multicolor toner image so that greater amounts of clear toner are deposited in image areas of the multicolor toner image having relatively higher density color and relatively lesser amounts of clear toner, including no clear toner, are deposited upon image areas of the multicolor toner image having relatively lower density color.

Other objects, advantages and novel features of the present invention will become more apparent from the following detailed description of the invention when considered in conjunction with the accompanying drawings.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings some elements have been removed and relative proportions depicted of the various disclosed elements may not be representative of the actual proportions, and some of the dimensions may be selectively exaggerated.

DETAILED DESCRIPTION OF THE INVENTION

Figure 1:
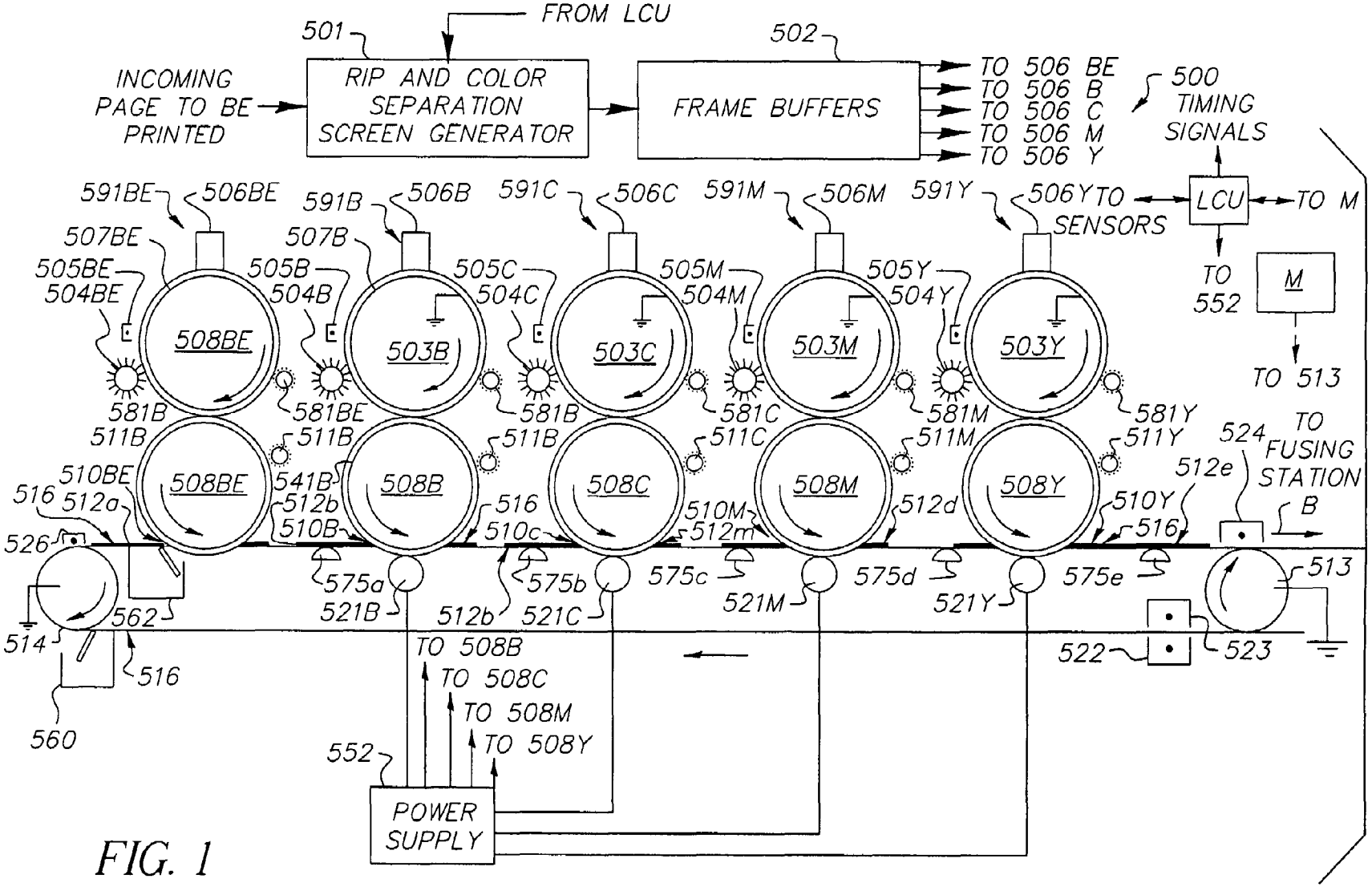
FIG. 1 is a schematic of an electrophotographic print engine that may be used in accordance with the invention to generate multicolor prints.
Figure 2:
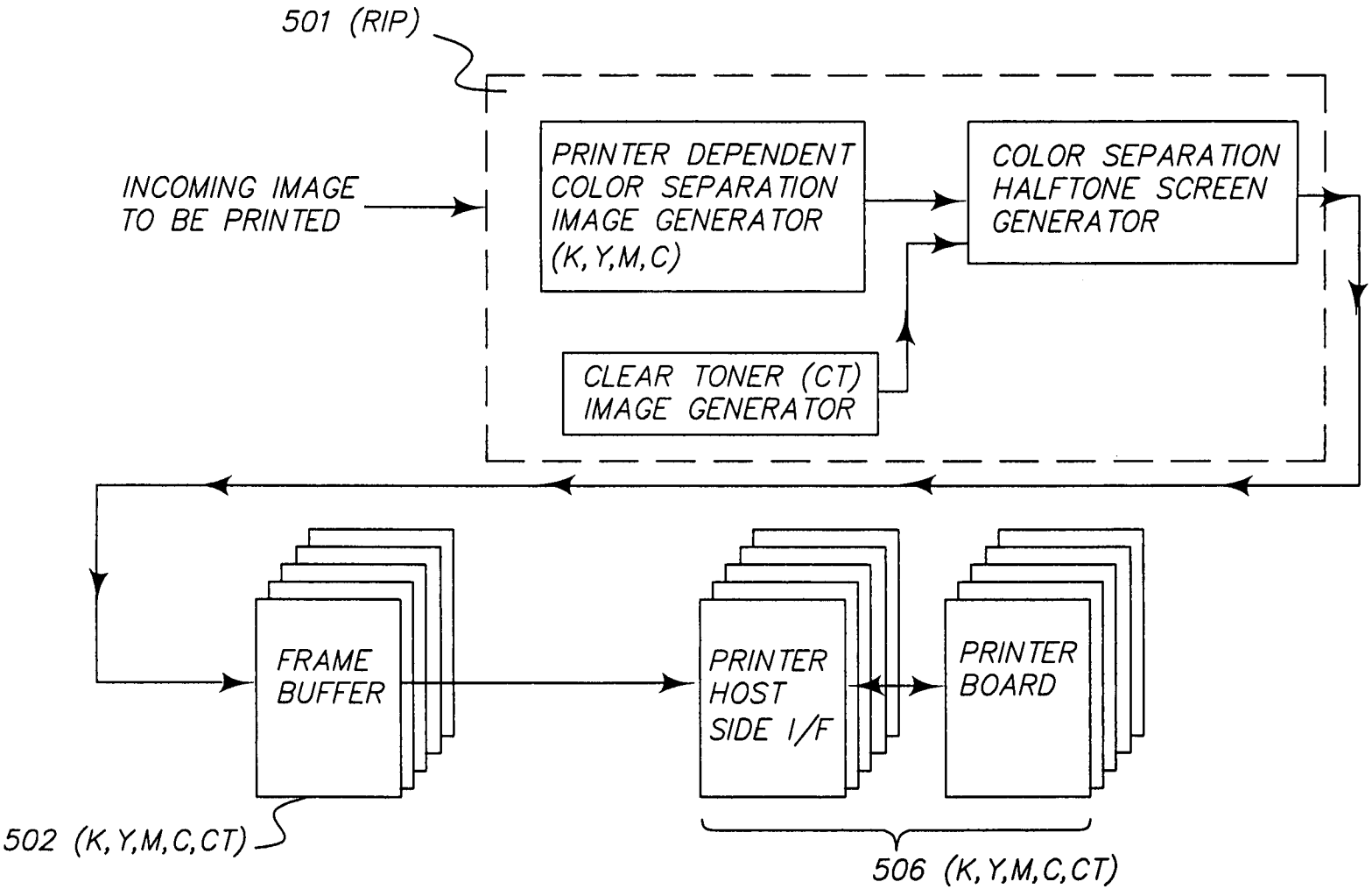
FIG. 2 is a schematic of an image processing system for providing image data to the print engine of FIG. 1 in accordance with the invention.

FIG. 1 is a side elevational view showing the essential portions of an electrophotographic print engine suitable for printing of full-color images in accordance with image information processed by the image processing system of FIG. 2 in accordance with the invention. Although one embodiment of the invention involves printing using an electrophotographic engine having repeating sets of single color image producing stations and arranged in a so-called tandem arrangement other electrostatographic color reproduction apparatus may make use of the invention.

With reference now to FIG. 1, there is shown a printer apparatus 500 having a number of tandemly arranged electrostatographic image forming modules. Although five modules are shown, it will be understood that the invention is applicable to a printer apparatus for printing at least two or more colors and an additional clear toner overlayer. Each module of the printer includes a plurality of electrophotographic imaging subsystems for producing a single color toned image. Included in each module is a charging subsystem for uniformly electrostatically charging a photoconductive imaging member, an exposure system for imagewise exposing the photoconductive imaging member to form a latent electrostatic color separation image in the respective color, a development subsystem for toning the imagewise exposed photoconductive imaging member with toner of the respective color, and an intermediate transfer subsystem for transferring the respective color separation image from the photoconductive imaging member to an intermediate transfer member and from the intermediate transfer member to a receiver member which receives the respective toned color separation images in superposition to form a composite multicolor image thereon. Subsequent to transfer of the respective color separation images from each of the respective subsystems, the receiver member is transported to a fusing subsystem to fuse the multicolor toner image to the receiver member. Further details regarding the printer 500 are also provided in U.S. Pat. No. 6,608,641 B1, the contents of which are incorporated herein by reference. An additional module for printing a clear toner "image" is also provided and is substantially similar to the referred to image forming modules each for producing a respective single color toned image.

The five exemplary modules of printer apparatus 500 are for preferably forming black, yellow, magenta, cyan color toner separation images, and a clear toner overall overcoat or partial overcoat as will be described herein. Although there is illustrated five such modules, it will be understood that the number of the modules may be increased to print more colors than four or reduced to print fewer colors than four. Elements in FIG. 1 that are similar from module to module have similar reference numerals with a suffix of K,Y,M,C and CT referring to a color module to which it is respectively associated; i.e. black (K), yellow (Y) magenta (M), cyan (C) and clear toner (CT). Each module (591K, 591Y, 591M, 591C, 591CT) is of similar construction except that, as shown, one receiver transport web (RTW) 516 in the form of an endless belt operates with all the modules, and the receiver member is transported by the RTW 516 from module to module. Receiver members are supplied from a paper supply unit, thereafter preferably passing through a paper conditioning unit (not shown) before entering the first module in the direction as indicated by arrow A. The receiver members are adhered to RTW 516 during passage through the modules, either electrostatically or by mechanical devices such as grippers, as is well-known. Preferably, receiver members are electrostatically adhered to RTW 516 by depositing electrostatic charges from a charging device, such as for example by using a tack-down corona charger 526. Five receiver members or sheets 512*a,b,c,d,e* are shown (simultaneously) receiving images from modules 591 K,Y,C,M, and CT. It will be understood, as noted above, that each receiver member may receive one color image from each module, and that in this example up to 4 color images plus a clear toner overcoat can be received by each receiver member. The movements of the receiver member with the RTW 516 is such that each color image transferred to the receiver member at the transfer nip 510 K,Y,M,C and CT of each module is a transfer that is registered with the previous color transfer so that a 4-color image plus clear toner "image" formed on the receiver member has the colors in registered superposed relationship on the transfer surface of the receiver member. The receiver members are then serially detacked from RTW 516 and sent in a direction indicated by arrow B to a fusing station (not shown) to fuse or fix the dry toner images to the receiver member. The RTW 516 is reconditioned for reuse by providing charge to both surfaces using, for example, opposed corona chargers 522, 523 which neutralize charge on the two surfaces of the RTW.

Each color module includes a primary image-forming member, for example a drum or primary image-forming roller (PIFR) labeled 503 K,Y,M,C and CT respectively. Each PIFR 503 K,Y,M,C and CT has a respective photoconductive surface structure 507 K,Y,M,C and CT having one or more layers, upon which a pigmented marking particle image or a series of different ones of such images is formed (individual layers of PIFRs are not shown). In order to form toned images, the outer surface of the PIFR is uniformly charged by a primary charger such as a corona charging device 505 K,Y,M,C and CT respectively, or by other suitable chargers such as a roller charger, a brush charger, etc. The uniformly charged surface is preferably exposed by a respective electronic image writer 506 K,Y, M,C and CT which exposure device is preferably an LED or other electro-optical exposure device, for example a laser to selectively alter the charge on the surface of the PIFR. The exposure device creates an electrostatic image corresponding to a color separation image to be reproduced or generated. The electrostatic image is developed, preferably using the well-known discharged area development technique, by application of pigmented marking particles to the latent image bearing photoconductive drum by development station 581 K,Y,M,C and CT respectively, which development station preferably employs so-called "SPD"(Small Particle Development) developers. Each of development stations 581 K,Y,M,C and CT is respectively electrically biased by a suitable respective voltage to develop the respective latent image, which voltage may be supplied by a power supply, e.g., power supply 552, or by individual power supplies (not illustrated). The respective developer includes toner marking particles and magnetic carrier particles. Each color development station has a particular color of pigmented toner marking particles associated respectively therewith for toning. Thus, each of the first four modules creates a series of different color marking particle images on the respective photographic drum. In lieu of a photoconductive drum which is preferred, a photoconductive belt may be used. Alternatively, the image may be created by an electrostatic charger that forms respective pixels of charge on an insulating surface directly in response to image information. As noted above, the clear toner module operates in similar manner to that of the other modules which deposit pigmented toner, however the development station of the clear toner module has toner particles associated respectively therewith that are similar to the toner marking particles of the color development stations but without the pigmented material incorporated within the toner binder.

Each marking particle image formed on a respective PIFR is transferred to a compliant surface 541 K,Y,M,C and CT of a respective secondary or intermediate image transfer member, for example an intermediate transfer roller (ITR) labeled 508 K,Y,M,C and CT respectively. After transfer to the ITR, the residual toner image is cleaned from the surface of the photoconductive drum by a suitable respective cleaning device 504 K,Y,M,C and CT respectively, so as to prepare the surface for reuse for forming subsequent toner images. The image transferred to the ITR is then electrostatically transferred in proper registration onto the receiver sheet in registered superposed relationship with any preceding color separation image. A respective cleaning device 511 K,Y,M,C and CT is also associated with each ITR for cleaning the surface thereof after transfer of the respective color separation image or clear toner "image" is made from the respective ITR to the receiver member.

A logic and control unit (LCU) provides control signals that control movement of the various components and elements of the printer apparatus 500 and the timing thereof as well as the appropriate electrical biases for forming the images and the biases provided by a power supply 552 for accommodating the various transfers of the respective toner images. Timing signals are also provided to a motor, M, which drives a drive roller 513 that, in turn, drives the RTW 516. The RTW may be used to drive the other components, and/or other drivers may be used to control movement of the rollers in the respective modules.

With reference now to FIG. 2 image data for writing by the printer apparatus 500 may be processed by a raster image processor (RIP) 501 which may include a color separation screen generator or generators. The output of the RIP 501 may be stored in frame or line buffers 502 for transmission of the color separation print data to each of the respective LED writers 506 K,Y,M,C and CT. The RIP 501 and/or color separation screen generator may be a part of the printer apparatus 500 or remote therefrom. Image data processed by the RIP may be obtained from a color document scanner or a digital camera, or generated by a computer or from a memory or network which typically includes image data representing a continuous image that needs to be reprocessed into halftone image data in order to be adequately represented by the printer apparatus. The RIP 501 may perform image processing processes including color correction, etc. in order to obtain the desired color print. Color image data is separated into the respective colors and converted by the RIP 501 to halftone dot image data in the respective color using threshold matrices which provide desired screen angles and screen rulings. The RIP 501 may be a suitably programmed computer and/or logic devices, and is adapted to employ stored or generated threshold matrices and templates for processing separated color image data into rendered image data in the form of halftone information suitable for printing.

The invention proceeds from the recognition that back-transfer occurs in the fifth module or sub-system when the fifth module is engaged and no clear toning occurs, for example through deselection by the operator or user of a clear overcoat layer for the print. Back-transfer is particularly troublesome in a high-density region of an image. The back-transfer artifact is more likely to occur where a high-density layer of one color of toner is put down on top of the higher density layer of another color of toner. When the image goes through a subsequent transfer station particularly a transfer station that is not being used to transfer toner, there is a tendency of some of the top layer of toner to be picked up by the transfer station, resulting in back-transfer artifacts such as mottle, streaks and bands in the resulting print.

With continued reference to FIG. 2, incoming image data to be printed is input to the RIP 501 and converted to printer dependent color separation image data in each of the four color images printed by the printer apparatus. The clear toner image generator, which also may be a part of the RIP, creates a clear toner "image" from the four color separation images previously created as will be further described in more detail below. Halftone screen generator or generators may also form a part of the RIP 501 and convert each of the four color separation images into color separation halftone screened images. Additionally, the halftone screen generators preferably convert the clear toner "image" into a halftone screen pattern of image information. The image data from each of the four halftone screened color separation images and clear toner halftone screen separation image are output to frame buffers 502 K,Y,M,C and CT respectively from which they are sent to a printer host side interface. A printer board communicates with the printer host side interface and includes supporting circuitry for outputting corrected image information for printing by each of the respective writers 506 K,Y,M,C and CT with appropriate synchronization.

Figure 3:
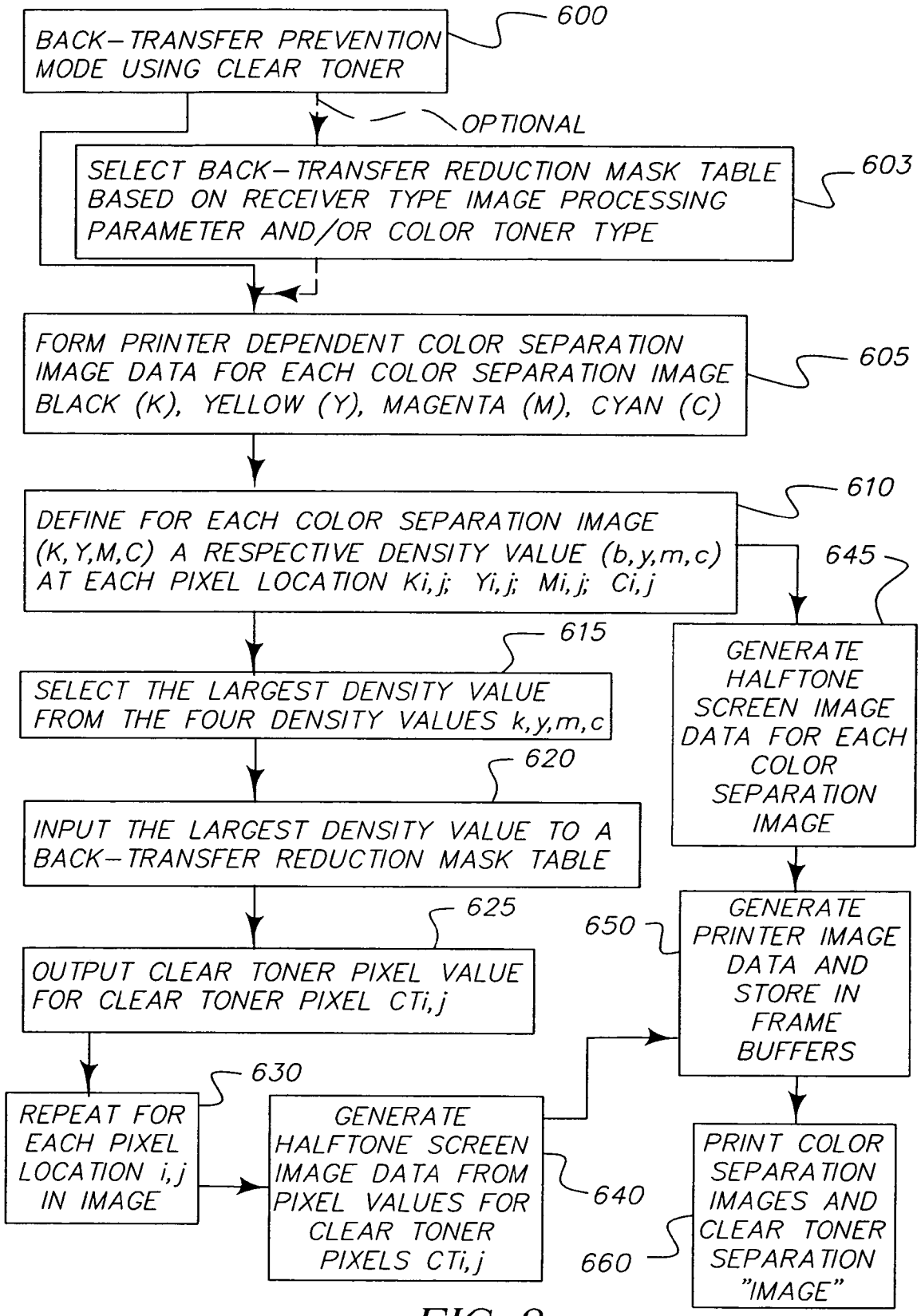
FIG. 3 is a flowchart illustrating operation of the image processing system of FIG. 2.

With reference now to FIG. 3, a back-transfer prevention mode using clear toner may be selected in step 600. In step 605 color image data received from various sources, as noted above, is converted to printer dependent color separation image data for each color separation image for black (K), yellow (Y), magenta (M) and cyan (C). For each color separation image a respective density value (k, y, m, c) is associated with each pixel location (Bi,j; Yi,j; Mi,j; Ci,j) of each color separation image (step 610). In step 615, the pixel density values (k, y, m, c) at pixel locations (Ki,j; Yi,j; Mi,j; Ci,j;) are examined to determine the largest density of the four pixel density values k, y, m, and c. The determined largest density value at the particular pixel location is input to a back-transfer reduction mask table associated with the RIP and a corresponding clear toner pixel value is output for clear toner pixel location CTi,j (steps 620 and 625).

Figure 6:
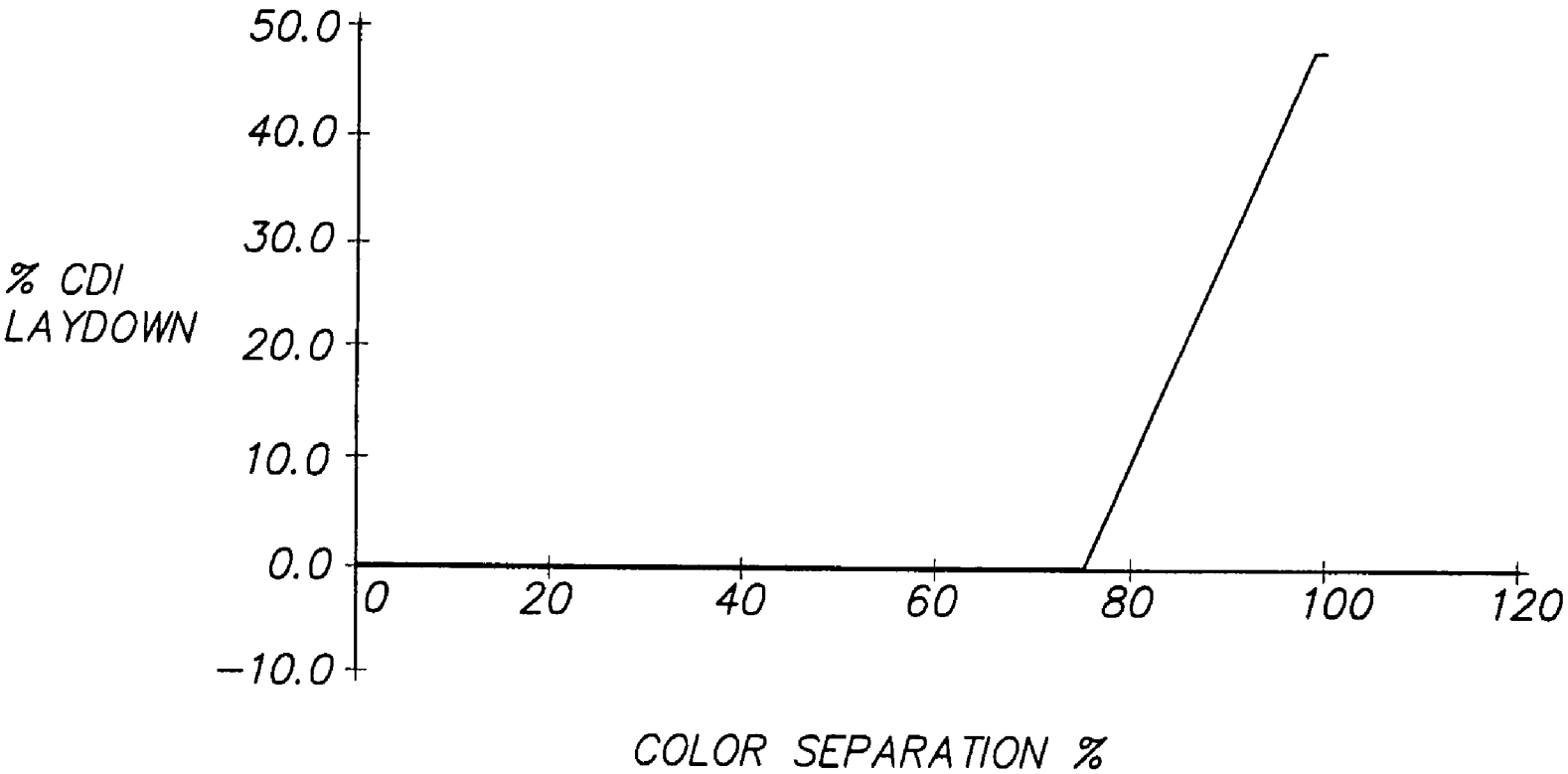
FIG. 6 is a graph illustrating a preferred relationship between color separation image density at a pixel location and an amount of clear toner overcoat to be provided at a generally corresponding pixel location to reduce the likelihood of generation of a back-transfer artifact.

With reference now also to FIG. 6, an example of a general relationship between density of a color image at a particular pixel location or image area and a preferred amount of clear toner to be applied to the area is shown. As may be noted from the graph, no clear toner or clear dry ink (CDI) is employed at pixel locations or image areas where color separation percent is less than 75%. For pixel locations or image areas where color separation percent is greater than 75% there is a generally a progressive increase in percent of clear toner laid down with increases of color density or color separation coverage. The generation of the "image" map for depositing the clear toner is generated for each pixel location i,j for the clear toner "image" (step 630). The generated image map for the clear toner image is then subjected to processing through a halftone screen generator (step 640). The halftone screen generated image information for each color separation image, produced in step 645 and the halftone produced screened image data clear toner image, produced in step 640, are modified to printer image data and stored in frame buffers (step 650). The printer image data may provide for correction for nonuniformities of the recording elements and/or other correction information. In accordance with well-known techniques for printing the information stored in the frame buffers are output at suitably synchronized times for imaging of the respective electrostatic color separation images and the clear toner image by the respective writers 506 B,Y,M,C and CT (step 660).

Although the preferred embodiment provides for the generation of the clear toner image as a halftone "image", it will be understood that it need not be produced as a halftone image but may be produced as a continuous tone image. One reason for the preference for halftone is that depositing of toner in the form of a halftone image provides for pixels of relatively greater stability during formation in the electrostatographic process. Furthermore, the traditional graphics printing practice is of using 15°/45°/75° angle screens to form a balanced cyan, magenta, black (CMK) rosette structure. In the CMYK four-color printing process, the yellow screen is usually at 0° or 45°. However, a moiré pattern resulting from the interaction of the yellow screen with the other three individual screens is not as visually pleasing as a 30° moiré pattern (rosette structure). Yellow is a light color, so this additional moiré is usually acceptable and difficult to notice in the conventional CMYK four color printing practice. In order to reduce visibility of the clear toner halftone image, it may be desirable, where possible, to set the screen angle of the clear toner image at an angle separated by about 30° from the halftone screened color images such as in areas of relatively high-density where only two color separation images are superposed.

In a four-color printing process, CMYK, the clear toner may be considered a fifth color and, in order to reduce gloss moiré, an appropriate halftone screen angle for forming the gloss "image" is selected in accordance with the teachings provided in U.S. application Ser. No. 10/837,518 filed on Apr. 30, 2004, in the name of Tai, et al., entitled "METHOD AND APPARATUS FOR MULTI-COLOR PRINTING USING DOT-LINE HALFTONE COMPOSITE SCREENS" and U.S. application Ser. No. 10/836,762 filed on Apr. 30, 2004, in the name of Tai, et al., entitled "METHOD AND APPARATUS FOR MULTI-COLOR PRINTING USING A ROSETTE OR DIAMOND HALFTONE SCREEN FOR ONE OR MORE OF THE COLORS", the contents of both of which applications are incorporated herein by reference.

Because there is provided higher laydown of clear toner in areas with higher color toner coverage, but little or no clear toner laydown where there is lower color toner coverage, the clear toner is generally not noticeable in the resulting image after the multicolor image with the clear toner overlying parts thereof have been fused together to permanently adhere the toner particles to the receiver sheet.

The specific back-transfer reduction mask set illustrated in FIG. 6 is merely exemplary. It will be noted that back-transfer is typically not severe until the toner coverage is relatively high, say about 75%. However, back-transfer is dependent upon the ratio of Q/M (toner charge to mass ratio). Thus, as charge on the toner layer increases, back-transfer may be expected to get worse even at lower toner coverages. In addition, it may be desirable to make the back-transfer mask curve adjustable or variable rather than having the straight-line increase as shown in FIG. 6. The curve may be optimized to reduce gamut loss and may be variable in accordance with substrate used for the receiver sheet or process stability or Q/M. In this regard, an optional step 603 may be provided as shown in the flowchart of FIG. 3, and in the to be described alternatives, illustrated with regard to FIGS. 4A and 4B and FIGS. 5A and 5B, wherein there is input or sensing of one more of factors including receiver type, electrostatographic process conditions including sensing of or determination of toner charge to mass, and toner type and in response selecting a suitable back-transfer reduction mask in accordance with the appropriate conditions.

As noted above, the back-transfer prevention mode may be selected by the printer operator/user or may be automatically provided by the LCU when the operator determines that a clear overcoat is not desired to be provided over the entire image. Thus, the invention contemplates that a printer apparatus and method is provided for operation in at least two modes: a first mode where clear toner is applied to cover the entire print, and a second mode as described herein for back-transfer prevention or reduction wherein clear toner is selectively applied only to areas of relatively high density or toner coverage. Although the determination of a pixel location or area of relatively high density is made through examination of the particular color separation image having the highest density at the pixel location or area, this is for convenience of simplifying calculations by the raster image processor (RIP 501). Other algorithms may be provided for identifying areas of relatively high density of toner coverage, such as by examining pixel locations having at least deposits of relatively large amounts of toner by two or more colors. In this regard, calculations may be made more complex due to the action of halftone patterns interfering with each other.

Figure 4A:
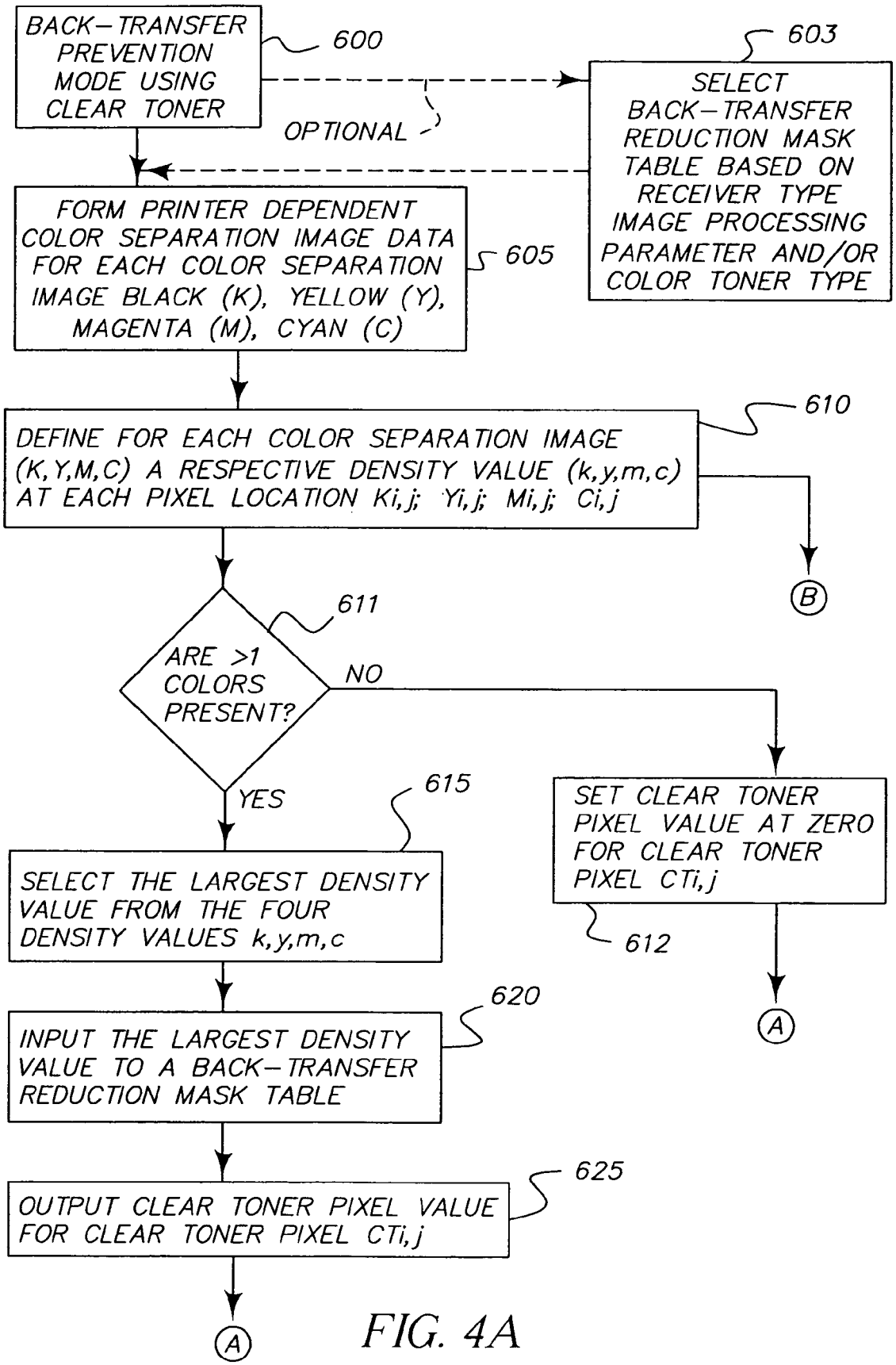
FIGS. 4A and 4B represent a flowchart illustrating operation of the image processing system of FIG. 2 in accordance with a second embodiment of the invention.
Figure 4B:
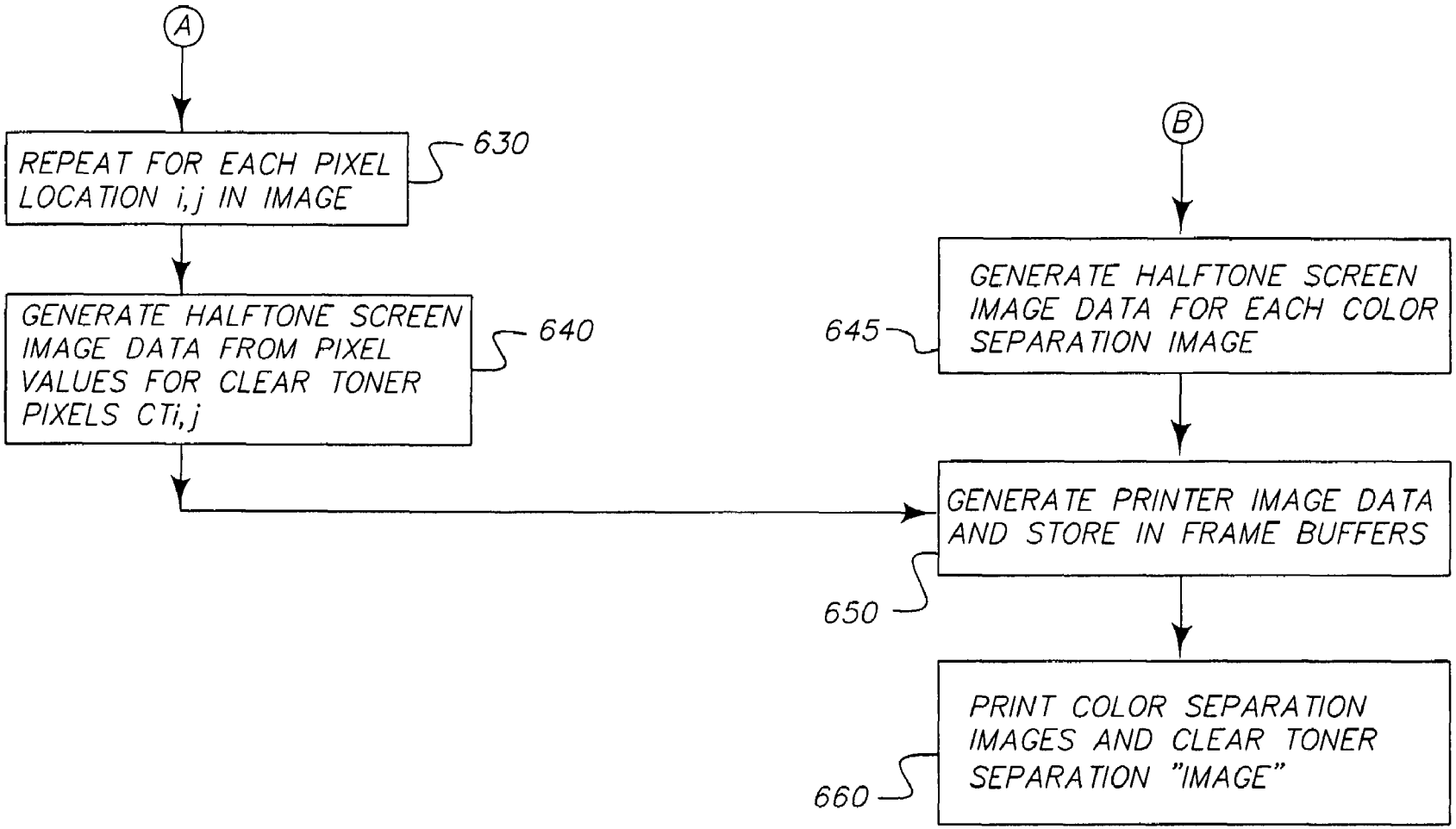

With reference now to FIGS. 4A and 4B, a first alternative embodiment of a flowchart is illustrated wherein the image processing provides for examination at each pixel location of whether or not plural colors are present at the pixel location. In the flowchart of FIGS. 4A and 4B, steps identical to that of FIG. 3 are provided with the same number. In step 611 a determination is made as to whether or not plural colors are present at the pixel location. If not, the clear toner pixel value is set to zero for the clear toner pixel CTi,j. If plural colors are present at this pixel location, then a determination is made of the clear toner pixel value in accordance with the procedure identified for FIG. 3.

Figure 5A:
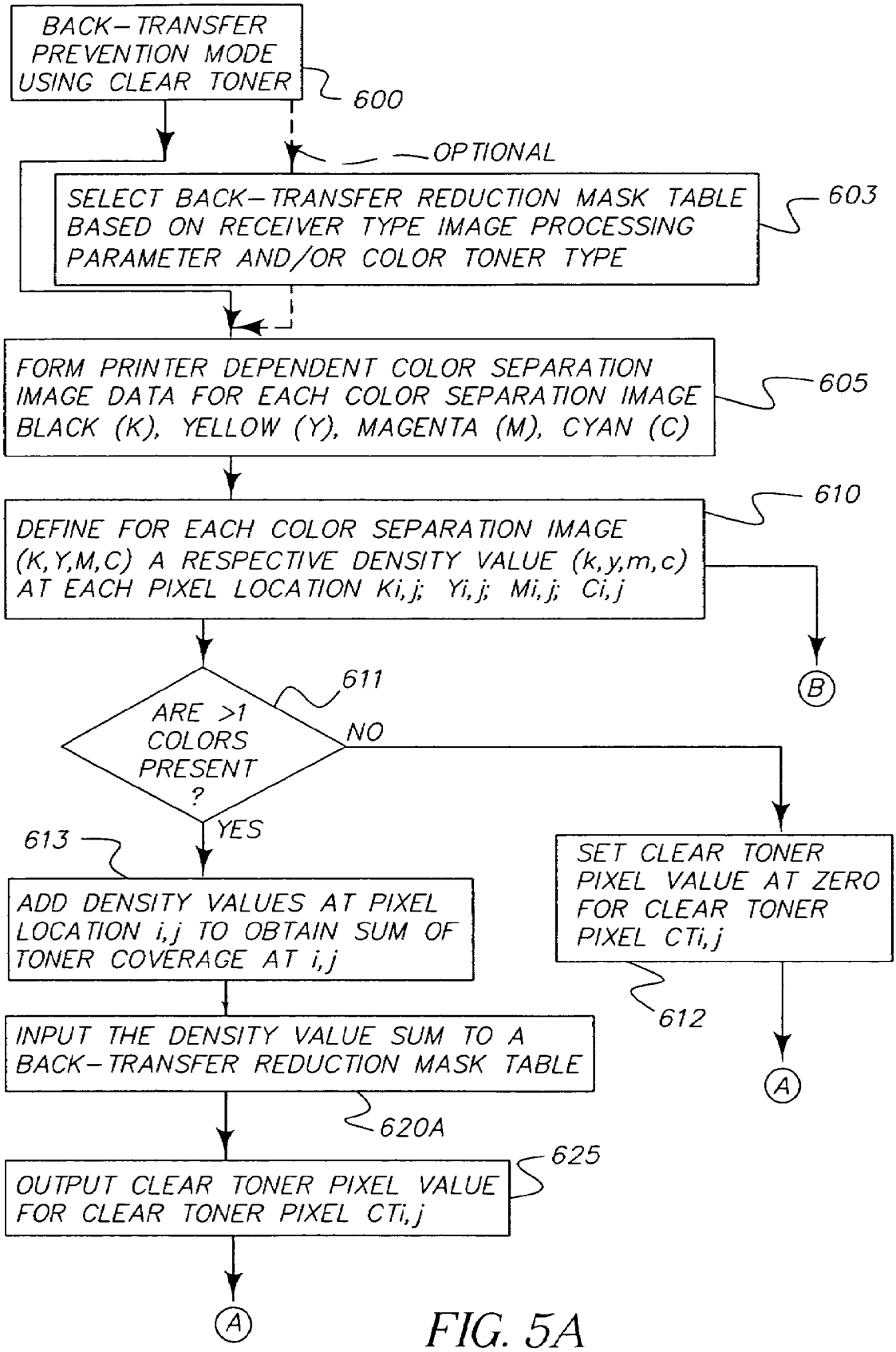
FIGS. 5A and 5B represent a flowchart illustrating operation of the image processing system of FIG. 2 in accordance with a third embodiment of the invention.
Figure 5B:
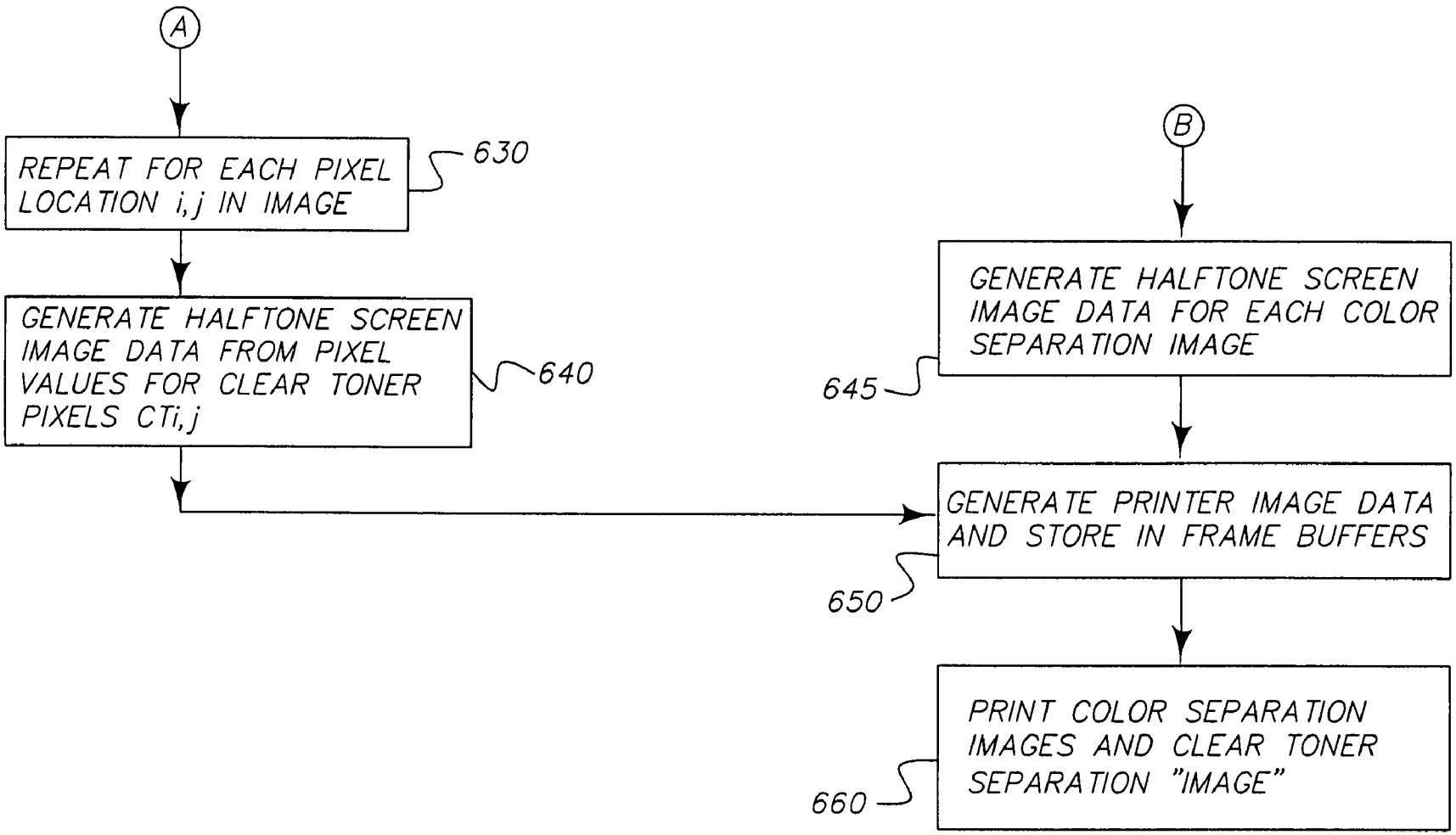

With reference now to FIGS. 5A and 5B, a second alternative embodiment of a flowchart is illustrated wherein the image processing provides for examination at each pixel location of whether or not plural colors are present at the pixel location. In similar manner to that explained with regard to the flowchart of FIGS. 4A and 4B, a determination in step 611 that plural colors are not present at the pixel location results in the clear toner pixel value being set to zero for this pixel location. The reason for this is to reduce the amount of clear toner used in producing the print by eliminating placement of clear toner at pixel locations where back-transfer does not impact greatly on image quality. Back-transfer tends to impact more significantly upon image quality at pixel locations where two or more colors are present. In the event that the determination of step 611 identifies a pixel location where plural colors are present, the density values of the respective colors present at the pixel location are summed to obtain the sum of toner coverage at the pixel location i,j. This sum of density values or toner coverages is then input to a back-transfer reduction mask table (step 620*a*). A clear toner pixel value for clear toner pixel CTi,j is then output (step 625), and the process is otherwise similar to that described for the flowchart FIG. 3. Although in the various embodiments, description has been made with regard to determining of a pixel value for clear toner in accordance with a corresponding amount of color separation toner at the counterpart pixel location, it will be understood that determination of a pixel value for clear toner and a pixel location may be made by examining a counterpart window of several pixels of color separation image data, and for example averaging the color separation image data in this window.

In lieu of the aforestated first mode wherein there is uniform application of clear toner to cover the entire image area, it is known to reduce the amount of clear toner by application of an inverse mask wherein one lays down more clear toner in areas that have less color toner coverage. In this third mode, balance is created in toner stack heights by providing relatively greater amounts of clear toner coverage to areas of an image having relatively lower amounts of color toner coverage, and lesser amounts of clear toner coverage to areas of the image having relatively greater amounts of color toner coverage. In this regard, reference is made to U.S. Pat. No. 5,234,783. Thus, the printer apparatus may be provided with a third mode of operation in addition to the aforestated first mode and the second mode. The third mode of operation is a mode of operation using the inverse mask which is generally opposite in concept from the aforestated second mode of operation of the invention and which second mode has been described in substantial depth in the specification and drawings herein. The controller of the printer, which preferably includes a computer, may be programmed so as to be operative, for example by selection by the operator, to process the printing of an image in accordance with anyone of the three selectable modes; that is, some prints may be formed that are uniformly covered with clear toner, other prints may be formed in accordance with the second mode wherein back-transfer artifacts are reduced or eliminated and without the need to and expense of providing uniform coverage of clear toner to the print, and still other prints may be formed in accordance with the third mode wherein balance is achieved in toner stack heights.

There has thus been shown an improved printer apparatus and method of printing and method of encoding image data wherein color images may be printed with minimization of artifacts through selective application of clear toner to portions of the image.

The invention has been described in detail with particular reference to certain preferred embodiments thereof, but it will be understood that variations and modifications can be effected within the spirit and scope of the invention.

What is claimed is:

1. A color electrostatographic printer apparatus having a plurality of tandem stations for applying respective color separation toner images to a receiver member and a clear toner station for providing a clear toner overcoat to a multicolor toner image formed by the respective color separation toner images on the receiver member, the apparatus further comprising:

a controller for selectively controlling deposition of clear toner to the multicolor toner image so that greater amounts of clear toner are deposited in image areas of the multicolor toner image having relatively higher density color, and relatively lesser amounts of clear toner, including deposits of no clear toner, are deposited upon image areas of the multicolor toner image having relatively lower density color.

2. The apparatus of claim 1, wherein said controller is operative to determine density of an image area in accordance with an examination of color density information of each of the color separation images.

3. The apparatus of claim 2, wherein said controller is operative to determine density of an image area at a pixel location in accordance with a determination at a corresponding pixel location of the color separation image having the greatest density.

4. The apparatus of claim 3, wherein said controller is operative to process color density information of the color image to generate color separation image information in accordance with a halftone screen pattern for each color separation image, and further wherein said controller, in accordance with a determination of density of an image area at a pixel location, processes information relative to deposition of clear toner in accordance with a halftone screen pattern.

5. The apparatus of claim 1, wherein said controller is operative to determine density of an image area at a pixel location in accordance with a determination at a corresponding pixel location of a color separation image having a greatest density.

6. The apparatus of claim 1, wherein said controller is operative to process color density information of the color image to generate color separation image information in accordance with a halftone screen pattern for each color separation image, and further wherein said controller, in accordance with a determination of density of an image area at a pixel location, processes information relative to deposition of clear toner in accordance with a halftone screen pattern.

7. The apparatus of claim 1, wherein said controller is operative to process information relative to deposition of clear toner in accordance with a halftone screen pattern.

8. The apparatus of claim 1, wherein said controller is operative to process information relative to deposition of clear toner in accordance with a continuous tone pattern.

9. The apparatus of claim 1, wherein said controller is operative to process application of clear toner in two different modes, a first mode wherein clear toner is applied uniformly to an entire multicolor image, and a second mode wherein clear toner is applied selectively so that greater amounts of clear toner are deposited in image areas of the multicolor toner image having relatively higher density color and relatively lesser amounts of clear toner are deposited upon image areas of the multicolor toner image having relatively lower density color.

10. The apparatus of claim 1, wherein said controller is operative to process application of clear toner in two different modes, a first mode wherein clear toner is applied selectively so that so that greater amounts of clear toner are deposited in image areas of a multicolor toner image having relatively lower density color and relatively lesser amounts of clear toner are deposited upon image areas of the multicolor toner image having relatively greater density color, and a second mode wherein clear toner is applied selectively so that greater amounts of clear toner are deposited in image areas of the multicolor toner image having relatively higher density color and relatively lesser amounts of clear toner are deposited upon image areas of the multicolor toner image having relatively lower density color.

11. In a color electrostatographic printer apparatus having a plurality of tandem stations for applying respective color separation toner images to a receiver member and a clear toner station for providing a clear toner overcoat to a multicolor toner image formed by the respective color separation toner images on the receiver member, the method comprising:

selectively controlling deposition of clear toner to the multicolor toner image so that greater amounts of clear toner are deposited in image areas of the multicolor toner image having relatively higher density color, and relatively lesser amounts of clear toner, including no clear toner, are deposited upon image areas of the multicolor toner image having relatively lower density color.

12. The method of claim 11, wherein a determination of density of an image area is made in accordance with an examination of color density information of each of the color separation images.

13. The method of claim 12, wherein the determination of density of an image area is made at a pixel location in accordance with a determination at a corresponding pixel location of a color separation image having a greatest density.

14. The method of claim 13, including processing color density information of the color image to generate color separation image information in accordance with a halftone screen pattern for each color separation image, and further wherein the controller, in accordance with a determination of density of an image area at a pixel location, processes information relative to deposition of clear toner in accordance with a halftone screen pattern.

15. The method of claim 11, wherein a determination is made of density of an image area at a pixel location in accordance with a determination at a generally corresponding pixel location of a color separation image having a greatest density.

16. The method of claim 11, wherein color density information of the color image is processed to generate color separation image information in accordance with a halftone screen pattern for each color separation image and further wherein in accordance with a determination of density of an image area at a pixel location, and processing information relative to deposition of clear toner in accordance with a halftone screen pattern.

17. The method of claim 11, including processing information relative to deposition of clear toner in accordance with a continuous tone pattern.

18. The method of claim 11, including processing information relative to deposition of clear toner in accordance with a halftone pattern.

19. The method of claim 18, including processing information relative to at least some color toners at different screen angles, and wherein the clear toner is processed at a screen angle different from that of a color toner formed beneath the clear toner.

20. The method of claim 11, wherein different prints are formed in accordance with application of clear toner in two different modes, a first mode wherein clear toner is applied uniformly to an entire multicolor image to form at least some prints, and a second mode wherein a print is formed so that clear toner is applied selectively to the print so that greater amounts of clear toner are deposited in image areas of a multicolor toner image having relatively higher density color and relatively lesser amounts of clear toner are deposited upon image areas of the multicolor toner image having relatively lower density color.

21. The method of claim 11, wherein different prints are formed in accordance with application of clear toner in two different modes, a first mode wherein clear toner is applied selectively so that greater amounts of clear toner are deposited in image areas of the multicolor toner image having relatively higher density color and relatively lesser amounts of clear toner are deposited upon image areas of the multicolor toner image having relatively lower density color, and a second mode wherein a print is formed so that clear toner is applied selectively to the print so that lesser amounts of clear toner are deposited in image areas of a multicolor toner image having relatively higher density color and relatively greater amounts of clear toner are deposited upon image areas of the multicolor toner image having relatively lower density color.

22. The method of claim 11, wherein a clear toner mask set for controlling deposition of clear toner is selectable in accordance with at least one of receiver type, process control conditions, or toner type.

23. The method of claim 11, wherein a factor in determining whether or not deposition of clear toner is to be made is a determination at pixel locations corresponding to pixel locations or counterpart areas where more than one color of toner is to be placed.

* * * * *